United States Patent [19]

Varon et al.

[11] 4,441,300

[45] Apr. 10, 1984

[54] BRACKET SUPPORT FOR WALL STUDS

[75] Inventors: David S. Varon, Highland Park; Burton L. Siegal, Skokie, both of Ill.

[73] Assignee: Crown Metal Manufacturing Company, Chicago, Ill.

[21] Appl. No.: 933,496

[22] Filed: Aug. 14, 1978

[51] Int. Cl.[3] ..... A47G 29/02; A47F 5/08

[52] U.S. Cl. ..... 52/732; 52/36; 248/243; 211/87; 211/182

[58] Field of Search ..... 52/36, 732, 731, 730; 211/103, 134, 148; 248/241, 243; 108/107

[56] References Cited

U.S. PATENT DOCUMENTS

| | | | |
|---|---|---|---|
| 3,325,585 | 6/1967 | Brenneman | 52/586 |
| 3,407,547 | 10/1968 | Doke | 52/36 |
| 3,417,537 | 12/1968 | Wilson | 52/731 |
| 3,648,419 | 3/1972 | Marks | 52/36 |
| 3,699,735 | 10/1972 | Smith | 52/403 |
| 3,730,477 | 5/1973 | Wavrunek | 52/36 |
| 3,828,495 | 8/1974 | Law | 52/36 |
| 4,021,987 | 5/1977 | Schnebel | 52/731 |

FOREIGN PATENT DOCUMENTS

| | | | |
|---|---|---|---|
| 419011 | 11/1934 | United Kingdom | 52/586 |

*Primary Examiner*—John E. Murtagh

*Attorney, Agent, or Firm*—Silverman, Cass & Singer

[57] ABSTRACT

A bracket retaining and support structure for cooperative engagement with a wall stud and adapted for receipt in passageways disposed thereon of the hook ends of support brackets for shelves or the like. The bracket support structure includes a pair of oppositely disposed elongate extruded metal members having respective matingly engageable tongue and groove portions to enable assembly of the channel members together to form the support structure. An elongate metal bar provided with said passageways along the length thereof is retained by said support structure in a slot formed between said channel members; a pair of closely spaced forwardly extending flanges on the channel members form an entranceway in the support structure opening to the passageways on the metal bar to permit insertion of the hook ends of the support brackets within the passageways. In one embodiment, the bar has closely-spaced cut-out portions or notches along the elongate edges thereof and the walls of the bar-receiving slot within which the bar is disposed are deformed into the notches to permanently retain the bar within the slot. In another embodiment, the bar is provided with knurling to bite into the walls of the slot upon permanent assembly of the bar therewithin. In further embodiments, the bar is provided with a rolled groove or a plurality of shear-form protruding portions to bite into the walls of the slot for permanent assembly of the bar therewithin.

10 Claims, No Drawings

BRACKET SUPPORT FOR WALL STUDS

BACKGROUND OF THE INVENTION

1. Field of the Invention

This invention relates generally to interior wall structures, and more particularly, to bracket support members for use with metal studding which forms the framework of such wall structures, said bracket support members having means for receiving the brackets in vertically adjustable arrangement along the length of said support members.

2. Description of the Prior Art

Interior walls of commercial buildings commonly are formed with metal studs adapted to receive therein insert members intended to carry brackets to support shelves or the like on the walls. The insert members are provided with passageways for receipt of the hook ends of such brackets which may selectively be positioned in the passageways and thereby enable location of shelves at any desired location upon the wall.

One such structure is disclosed in U.S. Pat. No. 3,394,507 which provides a stud member of special construction having an elongated narrow channel for slidably receiving a slotted metal supporting plate for the shelf brackets. The supporting plate is freely movable within the channel after fabrication and is delivered to the construction site in this condition. Following positioning of the stud on the job site, the supporting plate is permanently secured within the channel at a desired position by applying fasteners through the channel and into the plate. Use of the fasteners is required to prevent the supporting plate from slipping within the channel after the studding is in place and shelf supporting brackets are positioned thereon. The procedure, however, requires that the tradesperson who assembles the structure on the job site engage in the task of measuring for exact location of the supporting plates and thereafter applying the fasteners as required.

A modification of the aforesaid prior art structure is disclosed in U.S. Pat. No. 3,562,970 in which a stud member also of special construction with an elongated channel is adapted slidably to receive an extruded metal bracket retaining member. The extruded retaining member is provided with a web portion disposed between a pair of flange members opening to the face of the member into which the shelf brackets are received. The web portion is modified after extrusion of the retaining member by milling passageways therein and the hook parts of the shelf brackets are received in the passageways between the outstanding flanges. The flange members enhance the lateral rigidity of the shelf brackets when in position upon the retaining member, and in this respect the structure of this patent is an improvement over that of U.S. Pat. No. 3,394,507. The disadvantage of the last named patent wherein the supporting plate thereof must be fastened to the stud on the job site is not overcome by the structure of patent 3,562,970 which likewise must be so fastened to the stud; the said structure has additional disadvantages: the extruded metal from which it is formed does not possess optimum rigidity which would permit heavy loads to be carried thereon, and the extruded metal does not resist erosion. Further, the passageways formed in the web must be spaced relatively far apart to provide the strength necessary to carry even usual loads.

An improved version of the last discussed structure is disclosed in U.S. Pat. No. 3,668,827 which deals with the problem of fastening the bracket retaining member to the stud. In this patent, the retaining member is secured to the stud by a crimp or tongue member, thus eliminating the need for separate fasteners to accomplish this objective. The remaining disadvantages of the structure of patent 3,562,970 are not, however, dealt with.

One additional pertinent prior art structure is disclosed in U.S. Pat. No. 3,730,477. Unlike the previously discussed structures, this device is adapted for use with a metal stud of standard design comprising a pair of C-shaped members positioned back-to-back defining a space therebetween. The bracket retaining member of this patent is a one-piece structure which may be positioned within the space between the C-shaped members of the stud. A metal bar having passageways to receive the shelf brackets is slidably retained in a channel in the retaining member and the bar is secured within the retaining member by punching or stamping anchoring projections to enter notches provided on the bar. While this structure provides a retaining member for use with standard studs, the other disadvantages of the earlier prior art structures are not obviated.

SUMMARY OF THE INVENTION

The present invention is characterized by an elongate bracket retaining and support structure of two part construction including a pair of oppositely disposed extruded metal members having respective matingly engageable tongue and groove portions to enable assembly of the members together to form the support structure. A bar-receiving slot is formed between the members within which an elongate metal bar is disposed and securely retained in place upon assembly of the said members. Securement of the bar within the slot is effected by deforming portions of the outer wall of the slot proximate cut-out portions along the elongate edges of the bar to engage the same and prevent movement of the bar within the slot. Alternatively, the bar is knurled, provided with a rolled groove or a plurality of shear-form protruding portions is provided along the surface thereof to bite into the walls of the slot when engaged therein. The bar is provided with passageways along the length thereof for receipt of hook ends of support brackets to be retained by the retaining member. The retaining structure may be of configuration for cooperative engagement in a wall stud of special construction or for use between wall studs of conventional construction.

DESCRIPTION OF THE PREFERRED EMBODIMENTS

Figure 1:
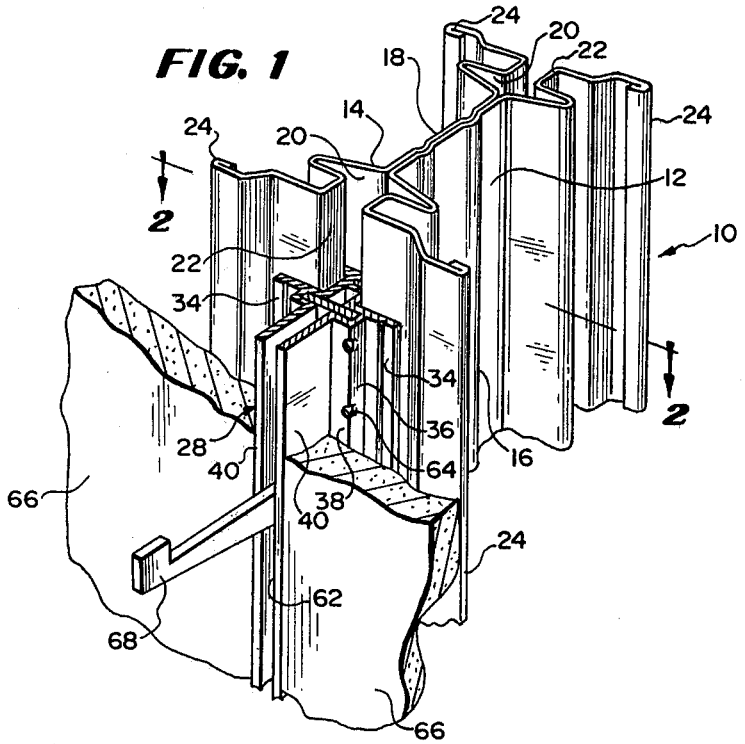
FIG. 1 is a fragmentary perspective view of a wall stud of special construction having the bracket retaining and support structure of the invention shown in position therewith.
Figure 2:
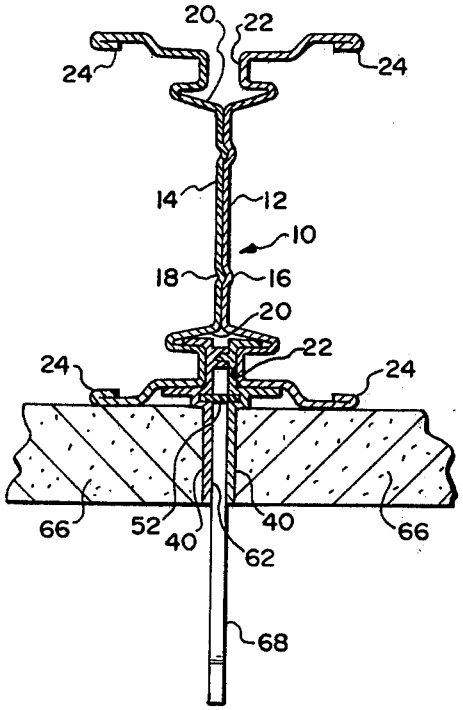
FIG. 2 is a sectional view taken along the line 2—2 of FIG. 1 in the direction indicated generally.
Figure 3:
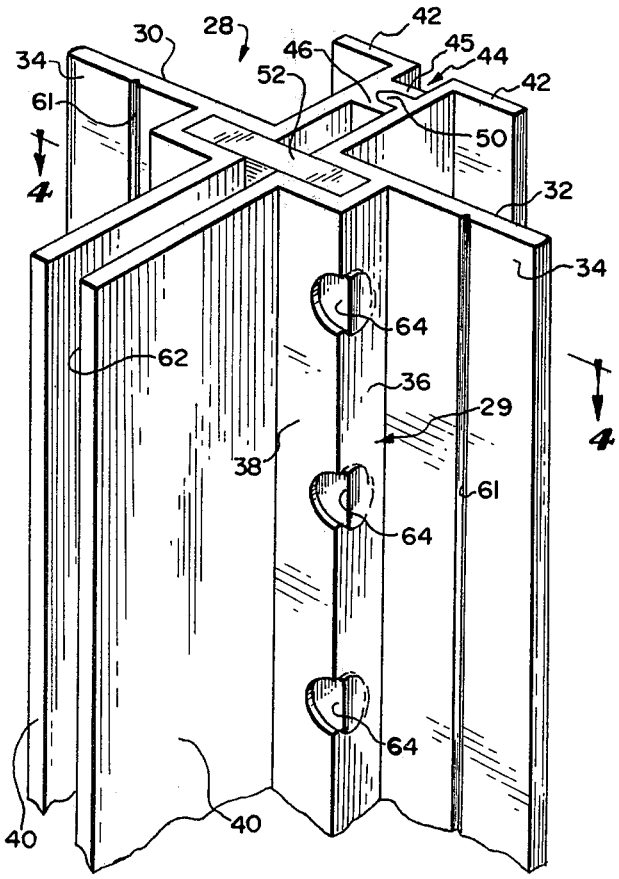
FIG. 3 is an enlarged fragmentary perspective view of the bracket retaining and support structure of the invention.
Figure 4:
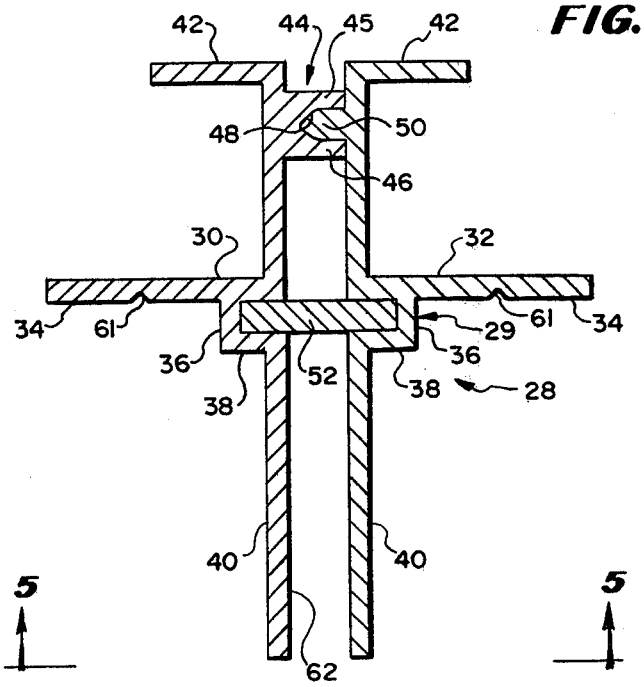
FIG. 4 is a sectional view taken along the line 4—4 of FIG. 3 in the direction indicated generally.
Figure 5:
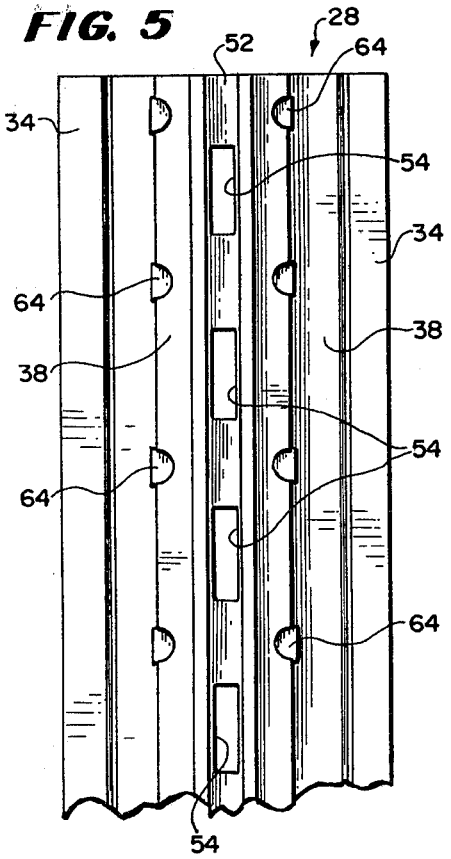
FIG. 5 is a sectional view taken along the line 5—5 of FIG. 4 in the direction indicated generally.
Figure 6:
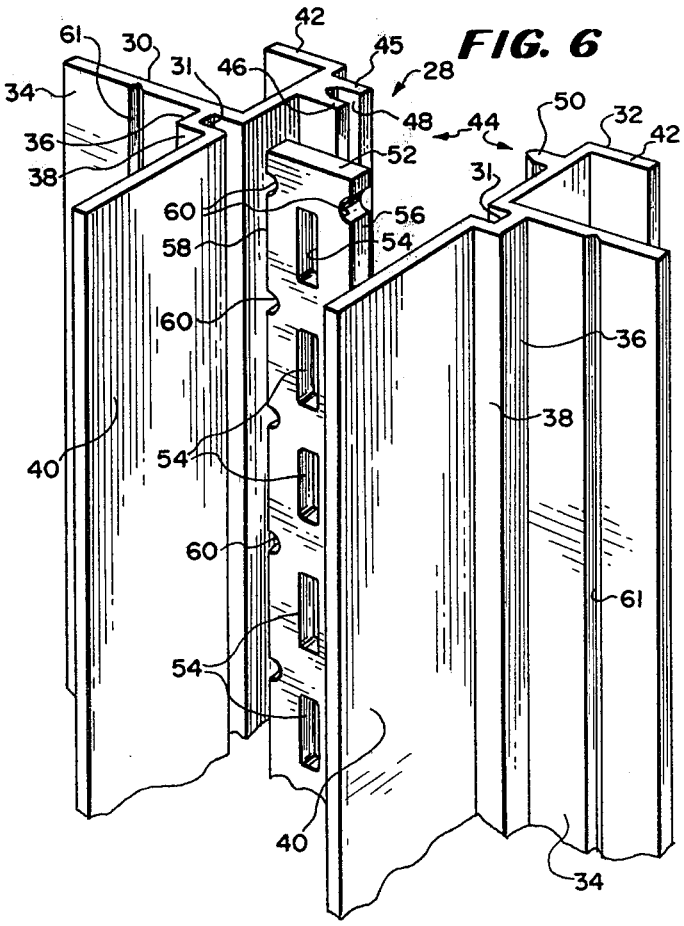
FIG. 6 is an exploded perspective view of the bracket retaining and support structure shown in FIG. 3.

The invention herein is adaptable for use with metal wall studs of either special or conventional construction. One such wall stud of special construction is illustrated in FIGS. 1 and 2. The stud 10 is formed of two sections 12, 14 of identical rolled steel shape welded or otherwise secured together along web portions 16, 18. The interconnected web portions form oppositely disposed channel formations 20 having narrow entranceways 22 for receipt therein of the bracket support structure as discussed below. The overall size of the metal stud 10 is defined by the longitudinal outermost edges of the outturned flanges 24 and this size is the same as a conventional wooden or metal stud as known in the art and used in the formation of partitions, walls and the like.

The bracket support structure for use in connection with specially-constructed stud 10 is designated by the reference numeral 28. Bracket support structure 28 is shown in assembled condition in FIGS. 1–5, and positioned on stud 10 in FIGS. 1 and 2. The structure 28 comprises a pair of elongate members 30, 32, each preferably formed as an extruded metal shape having a lateral wing 34 formed integral with each respective member. Each member 30, 32 has a central wall structure 29 comprising walls 36,38 disposed normal with respect to one another to define a rectangular groove 31 on the respective members 30, 32. Each groove 31 forms approximately half of a bar-receiving slot therein as described hereinafter.

A forwardly extending flat flange 40 is formed on the wall 38 of each respective member and a generally L-shaped flange 42 is formed on the side of lateral wing 34 opposite that on which the groove-forming walls 36, 38 are formed.

Each elongate member 30, 32 is nearly identical in configuration and said members differ in construction only with respect to matingly engageable joining means 44 formed on the respective L-shaped flanges 42 of the members. A pair of upstanding groove-forming walls 45, 46 are provided on flange 42 of channel member 30 to form the generally V-shaped groove 48 therebetween, and a projection 50 of configuration for mating engagement in groove 48 is formed on flange 42 of channel member 32. The flange 50 and mating groove 48 are dimensioned for interference or frictional interlocking fit one within the other when the members 30, 32 are assembled as shown.

Prior to assembly of channel members 30, 32, a flat elongate bar 52 is positioned between groove-forming walls 36, 38 of each member for disposition therewithin in a bar-receiving slot formed by the grooves 31 as described hereinabove. Bar 52 preferably is formed of high-strength steel of about the same length as that of the members 30, 32. A plurality of closely-spaced passageways 54 is provided on the bar along the centerline of the length thereof, and the opposite elongate edges 56, 58 of the bar have cut-out notches 60 spaced therealong. Upon assembly of the members 30, 32 with flange 50 disposed in groove 48, bar 52 is positioned within the rectangular groove formed by the walls 36, 38 with the passageways 54 opening to an intervening space 62 defined by the flanges 40 of the members 30, 32. Thereafter, the walls 36, 38 of the members 30, 32 are deformed by a punching operation along the length thereof to depress the metal thereof into engagement with the bar 52 such that the deformations 64 resulting from said punching operation project into the notches 60 of the bar. The bar thereupon becomes firmly and permanently secured within the walls 36, 38 of the assembled bracket support structure 28.

During assembly as described, it is important that the deformations 64 engage within the notches 60 and not therebetween so that there is no possibility of slipping of the bar 52 within its channel after the structure 28 is positioned for use on a wall stud 10. The required securement can be achieved by reason of the closely spaced notches which present a suitable number of locations where the deformations will grasp the bar.

The support structure 28 is assembled upon the stud 10 at the job site by sliding the same within the channel 20 of the stud such that the flanges 42 are disposed with the channel 20. Wallboard 66 next is secured upon the stud 10 by positioning the same overlying the lateral wing 34 with the edges of the wallboard abutting the flat flanges 40. The wallboard may be secured to the stud by fasteners (not shown) which penetrate lateral wings 34 along grooves 61 provided. The finished construction thereupon includes an intervening space 62 opening to the passageways 54 of the support structure 28. Conventional metal brackets 68 having hook ends (not shown) thereupon may be positioned at any desired location along the bar 52 by engaging the hook ends within the passageways 54. The brackets then may be used to support shelving or other fixtures as desired. It is to be understood that a standard wall construction will include several studs 10 disposed parallel to each other, and that each stud will include a support structure 28 for receipt of the brackets 68 such that any of a wide variety of shelving arrangements, etc., may be employed upon the wall.

Figure 7:
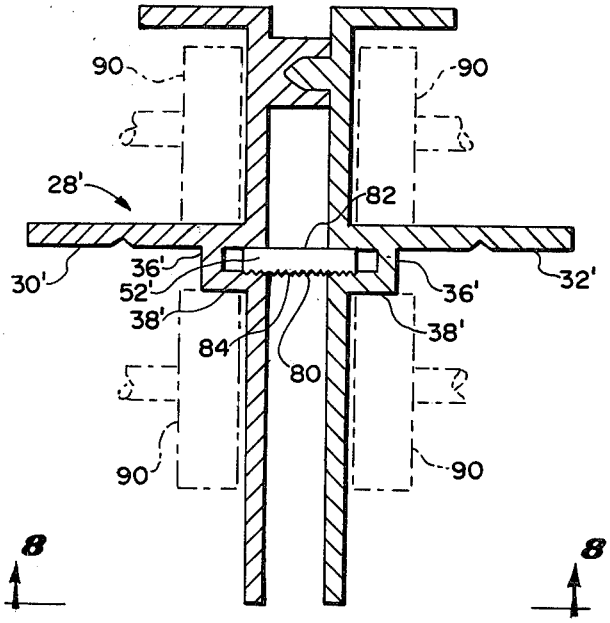
FIG. 7 is a sectional view similar to that of FIG. 4 but illustrating a modified form of the invention and the manner in which the same is assembled.
Figure 8:
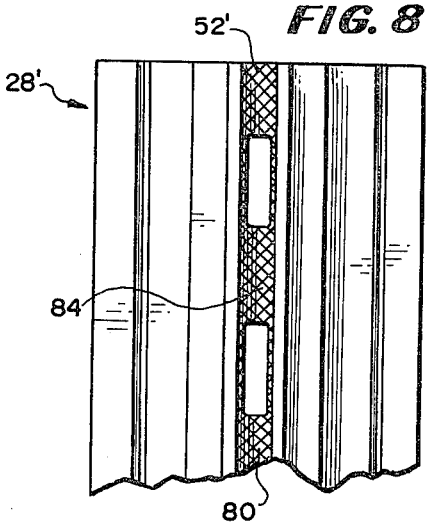
FIG. 8 is a sectional view taken along the line 8—8 of FIG. 7 in the direction indicated generally.
Figure 9:
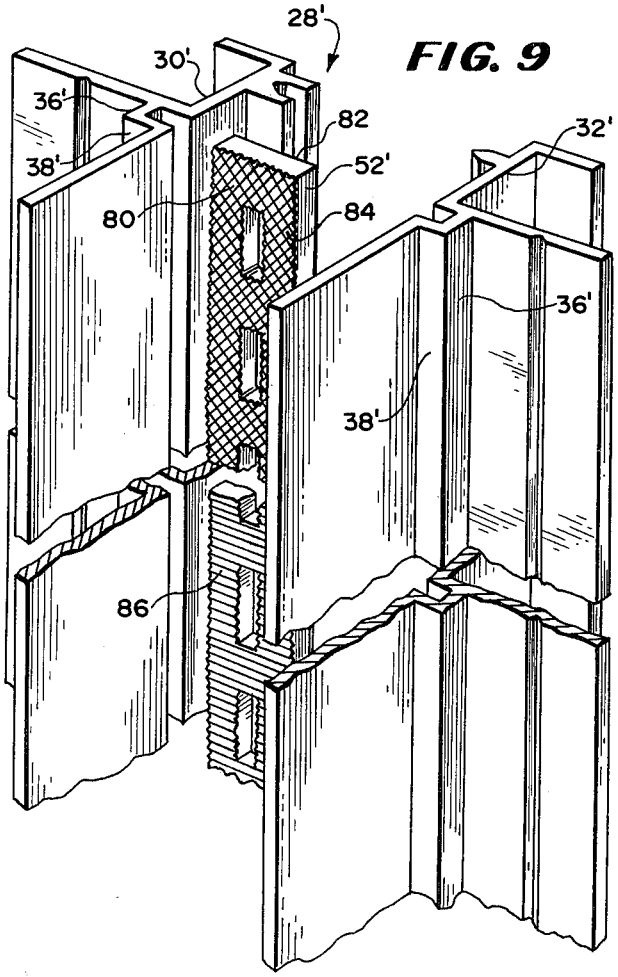
FIG. 9 is an exploded perspective view similar to that of FIG. 6 but illustrating a modified form of the invention with two different types of knurling on the bar thereof.

Looking now at FIGS. 7–9, a modified construction 28' of the structure 28 is shown. In the embodiment 28', all elements of the structure 28 are the same except for the bar 52 and the manner in which the same is secured within the bar-receiving slot formed by the rectangular grooves 31 of walls 36, 38. Rather than being formed with notches 60, the bar 52' of support structure 28' is provided with knurling upon one or both flat surfaces 80, 82 thereof. The knurling may be continuous across a surface 80, 82, or may be interrupted proximate the slots 54. The type of knurling can be of herringbone design as indicated at 84, or may be parallel grooves forming the knurling 86 illustrated in the lower portion of FIG. 9. It is to be understood that only one type of knurling will be provided along the length of the bar 52' and that the two types shown in FIG. 9 are for purposes of illustrating possible choices only.

When the bar 52' having parallel knurling 86 is used with the elongate members 30', 32', the rectangular grooves formed by walls 36', 38' are of a transverse dimension such that there is an interference fit between the bar 52' and the grooves. Upon assembly of the two members 30', 32' together, the knurling 86 will dig into the walls of the grooves and provide a tight permanent fit therewith. With use of a bar 52' having herringbone knurling 84 (FIGS. 7 and 8), the grooves formed by walls 36', 38' initially are formed wider than the thickness of the bar to permit the bar to be loosely positioned within the grooves. Thereafter, the walls 38' may be closed firmly against the bar by rollers 90 such that the knurling 84 digs into the walls of the channel to achieve the desired permanent assembly. The remainder of the structure 28' being the same as that of structure 28, assembly and use of the same in connection with a stud is that as previously described.

Figure 10:
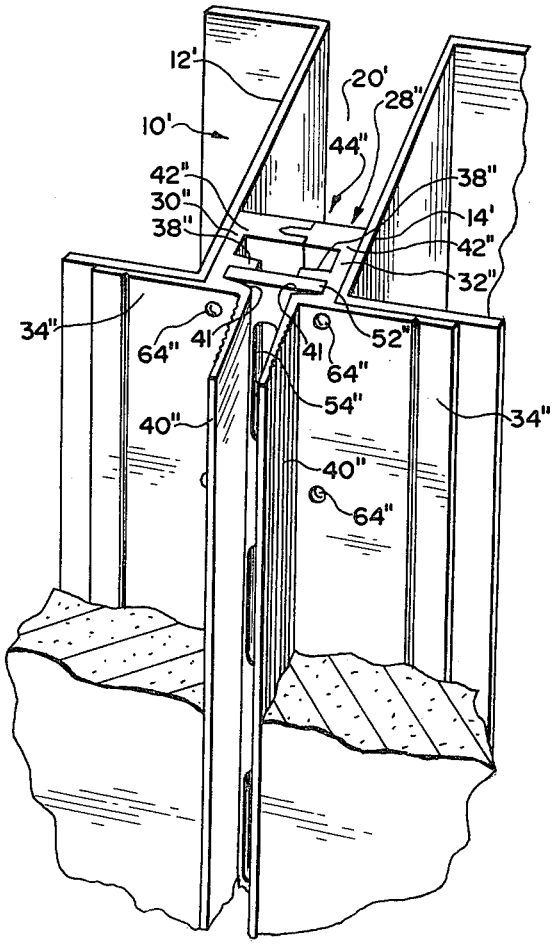
FIG. 10 is a fragmentary perspective view of a wall stud of conventional construction having a modified form of the bracket retaining and support structure of the invention shown in position therewith.

The bracket support structure 28, 28' described heretofore is adapted for use with a wall stud 10 of special construction. The structure may be modified in certain minor respects so that the same may be used in a wall assembly using metal or wood studs of so-called standard or conventional construction. Referring to FIG. 10, the bracket support structure 28'' is shown as used with a conventional metal stud 10'. Stud 10' comprises a pair 12', 14' of C-shaped members positioned back-to-back with a space 20' therebetween. Support structure 28'' is analagous in construction to structures 28, 28', but does not comprise the special flange members of the latter which are adapted to be slidingly received in the stud 10. Support structure 28'' includes a pair of generally identical members 30'', 32'', each formed as an extruded metal shape having lateral wing 34'' formed integral with each respective member and a forwardly extending flange 40'' formed thereon. A respective L-shaped wall extension 42'' is formed on the channel members facing opposite the flanges 40'', and each extension includes an outstanding member 38'' which cooperates with a portion of the flange 34'' to form a groove 41 therebetween. Matingly engageable joining means 44'' of the same construction as joining means 44 previously described are formed on the extensions 42''. A bar 52'' having passageways 54'' and notches (not shown) is positioned within the grooves 41 when the members 30'', 32'' are assembled in the same manner as members 30, 32. The wings 34'' thereupon are machine-punched to produce deformations 64'' which project within grooves 41 to secure bar 52'' therein as previously described.

Figure 11:
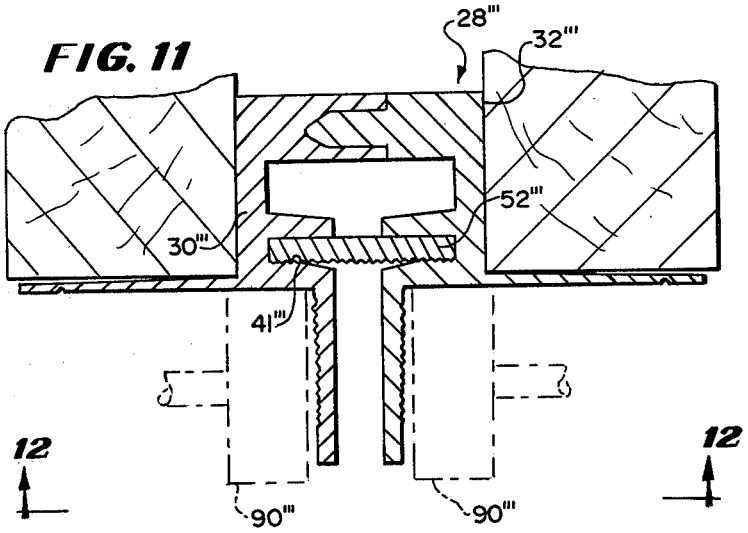
FIG. 11 is a top plan view of the retaining structure shown in FIG. 10 with the bar thereof having knurling thereon and showing the manner in which the structure is assembled.
Figure 12:
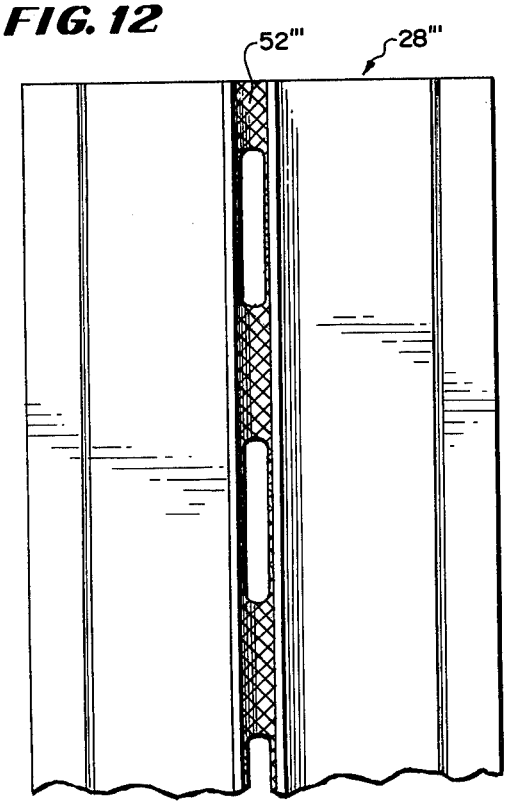
FIG. 12 is a sectional view taken along the line 12—12 of FIG. 11 in the direction indicated generally.
Figure 13:
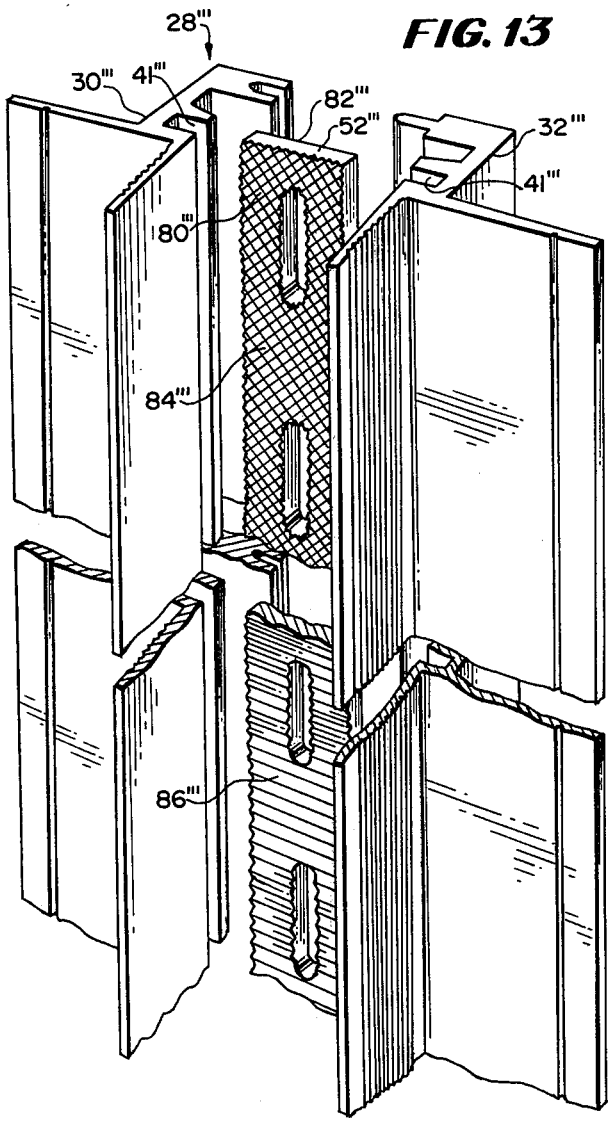
FIG. 13 is an exploded perspective view of the bracket retaining structure shown in FIG. 12 illustrating a modified form thereof with two different types of knurling on the bar thereof.

A modified construction 28''' of support structure 28'' is shown in FIGS. 11—13. The structure 28''' is illustrated in FIG. 11 positioned between conventional wood studs. The constructional details of support structure 28''' are analagous to those of structure 28' wherein the bar is knurled rather than provided with notches to enable securement thereof within its respective groove. As in the case of structure 28', the bar 52''' may be knurled on either or both surfaces 80''', 82''' thereof with herringbone knurling 84''' or parallel knurling 86'''. If the parallel knurling 86''' is used, the groove 41''' is dimensioned for interference fit with the bar 52''' and the bar will be permanently retained in the grooves when the two members 30''', 32''' are assembled together. If the herringbone knurling 84''' is used, the grooves 41''' are formed with wide mouths to loosely receive bar 52''' therein, after which rollers 90''' may be applied to the walls of the grooves 41''' to close the same upon the bar.

Figure 14:
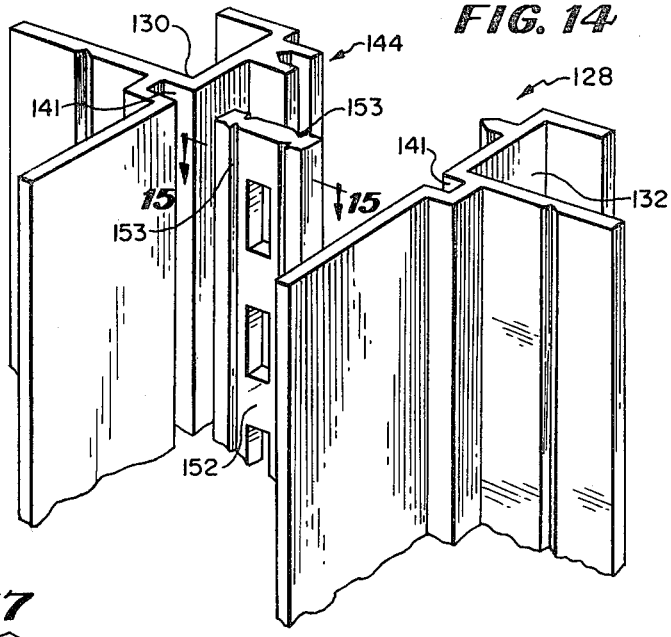
FIG. 14 is an exploded perspective view similar to that of FIG. 6 but illustrating a modified form of the invention with rolled grooves provided along the respective elongate edges of the bar thereof.
Figure 15:
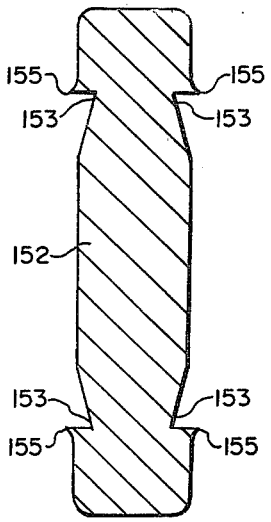
FIG. 15 is a sectional view taken along the line 15—15 through the bar of FIG. 14 in the direction indicated generally.

Referring to FIGS. 14 and 15, a still further modified construction 128 of the support structure of the invention is shown. In this embodiment, the constructional details of support structure 128 are identical to those of structure 28, there being a pair 130, 132 of members with respective channels 141 and matingly engageable joining means 144 to enable securement of the members 130,132 together in the manner previously described. The bar 152 of this embodiment is formed with longitudinal grooves 153 extending along the elongate edges and on both surfaces thereof. The grooves 153 preferably are formed on the bar by rolling during which formation the metal from which the bar is produced will flow or extrude to form upstanding barbed portions 155 of the grooves. In assembly of the embodiment 128, the two members 130, 132 are moved together with the bar 152 positioned for engagement in the channels 141 which are dimensioned for interference fit with the bar; the barbs 155 thereupon will bite into the channels for permanent retention therein.

Figure 17:
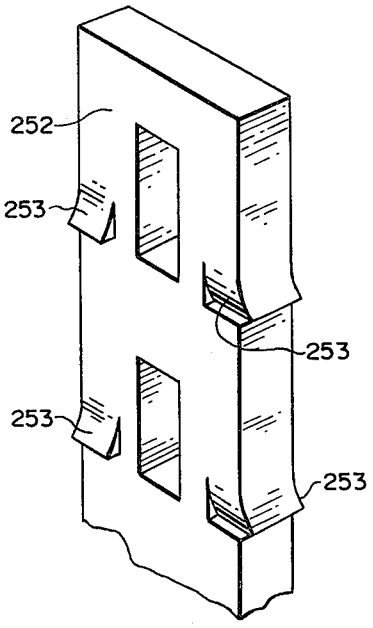
FIG. 17 is an enlarged fragmentary perspective view of the bar of FIG. 16.
Figure 16:
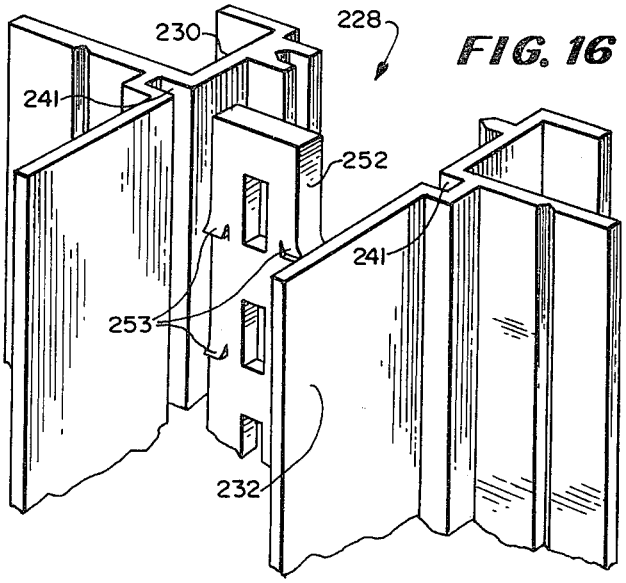
FIG. 16 is an exploded perspective view similar to that of FIG. 14 illustrating a still further modified form of the invention with a plurality of shear-form protruding portions provided along the respective elongate edges of the bar thereof.

One further modified construction 228 is illustrated in FIGS. 16 and 17. The support structure 228 is the same as structure 128. In this embodiment, the bar 252 is formed along the elongate edges thereof with a plurality of spaced shear deformations 253 which may be produced by shearing the edges of the bar at spaced locations therealong. The deformations 253 may be formed to protrude along a common surface of the bar or to protrude along opposite surfaces of the bar as shown in the figures. When the members 230, 232 are moved together with the bar 252 positioned therebetween, the deformations 253 will engage and bite into the walls of channels 241 for permanent retention of the bar therewithin.

Figure 18:
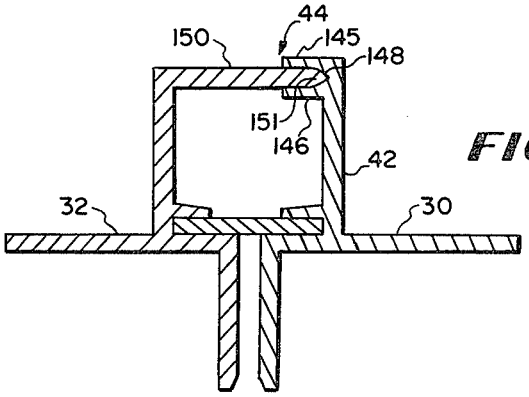
FIG. 18 is a top plan view of a modified form of the retaining structure in which the joining means of the channel members thereof are offset from the central axis of the said joining means.

In FIGS. 1 through 17, the matingly engageable joining means 44 formed on the respective flanges 42 of the members 30, 32 are disposed such that joinder thereof occurs approximately half way between the two members 30, 32 when the same are assembled with the bar 52 in place. In FIG. 18, a modification of this arrangement is shown wherein the joinder location of the joining means 44 is not located proximate the mid point as in the prior embodiments. In the FIG. 18 embodiment, the member 30 is formed with a pair of upstanding groove-forming walls 145, 146 upon flange 42 with the V-shaped groove 148 therebetween. The projection 150 is an elongate member having a tip 151 for mating engagement in groove 148 at a location proximate the wall of flange 42 such that the joinder of the means 44 will be off-set from the mid point of the assembled construction. The off-set location of the joinder of means 44 results in a more rigid assembly between the members 30, 32.

It will be appreciated from the above description that many variations in the structure of the invention and in the method of assembling the same may be made without departing from the spirit or scope thereof as defined in the appended claims.

I claim:

1. A bracket retaining and support structure for use with wall studs and adapted for having a plurality of hook-ended brackets mounted thereto and comprising:

A. a pair of elongate extruded metal members secured together, each member having central wall structure defining a rectangular groove forming approximately half of a bar-receiving slot therein and the grooves being aligned, opening to one another and spaced apart to provide an intervening space therebetween, B. cooperative friction interlocking means effective when engaged to secure the members together along the lengths thereof at the rear of said structure, the interlocking means being spaced from said bar-receiving slot, C. a lateral wing formed integral with said respective member, outwardly extending therefrom and adapted to receive wallboard thereon, said wings being located at the center of said structure and defining a plane generally parallel with the plane of said bar-receiving slot, D. a forwardly extending flange on the front of each member, said flanges being spaced apart, opening to said intervening space and adapted to straddle brackets inserted therein, and E. a flat bar engaged within said bar-receiving slot and bridging the intervening space and tightly secured in said rectangular grooves along opposite, vertical, elongate edges thereof to cooperate with said interlocking means to maintain the structure in assembly as a unit, said bar having vertically disposed central spaced passageways aligned with the space formed between the forwardly extending flanges so as to be able to receive the hook ends of brackets which are inserted through said last-mentioned space, and the bar is provided with knurling along at least one flat surface thereof.

2. A structure as claimed in claim 1 in which the knurling is continuous across said surface.

3. A structure as claimed in claim 1 in which the knurling is interrupted proximate the passageways on said bar.

4. A structure as claimed in claim 1 in which the knurling is formed of parallel grooves transverse of the elongate dimension of said bar.

5. A structure as claimed in claim 1 in which the knurling comprises a respective longitudinal groove extending along the elongate edges of said bar, each groove including an upstanding barbed edge to engage an inner-facing wall of said bar-receiving slot.

6. A structure as claimed in claim 4 in which the knurling comprises and the grooves are formed by a plurality of spaced shear deformations along the elongate edges of said bar, said shear deformations projecting beyond the surface of the bar to engage the inner-facing walls of said bar-receiving slot."

7. A bracket retaining and support structure for use with wall studs and adapted for having a plurality of hook-ended brackets mounted thereto and comprising:

A. a pair of elongate extruded metal members secured together, each member having central wall structure defining a rectangular groove forming approximate half of a bar-receiving slot therein and the grooves being aligned, opening to one another and spaced apart to provide an intervening space therebetween, B. cooperative friction interlocking means comprising a receiving groove on one member and a locking tongue on the other member effective when engaged to secure the members together along the lengths thereof at the rear of said structure, the interlocking means being spaced from said bar-receiving slot, C. a lateral wing formed integral with said respective member, outwardly extending therefrom and adapted to receive wallboard thereon, said wings being located at the center of said structure and defining a plane generally parallel with the plane of said bar-receiving slot, D. a forwardly extending flange on the front of each member, said flanges being spaced apart, opening to said intervening space and adapted to straddle brackets inserted therein, and E. a flat bar engaged with said bar-receiving slot and bridging the intervening space and tightly secured in said rectangular grooves along opposite, vertical, elongate edges thereof to cooperate with said interlocking means to maintain the structure in assembly as a unit, said bar having vertically disposed central spaced passageways aligned with the space formed between the forwardly extending flanges so as to be able to receive the hook ends of brackets which are inserted through said last mentioned space, and the bar is provided with knurling along at least one flat surface thereof, said knurling giving rise to grooves and protruding deformations, said grooves and the deformations having sharp edges arranged transversely of the long dimension of the bar-receiving slot during assembly of said extruded metal members, the lesser dimension of the bar-receiving slot being substantially the same as the thickness of the bar whereby the deformations will dig into at least one inner-facing wall of the bar-receiving slot during assembly of the extruded members.

8. The structure as claimed in claim 7 in which the deformations extend fully across the bar.

9. The structure as claimed in claim 7 in which the deformations extend partway across the bar, there being no deformations along the line of said passageways.

10. The structure as claimed in claim 7 in which the deformations are barb-like in character rising from the plane of the said flat surface whereby to resist sliding movement of said bar in said bar-receiving slot.

* * * * *